United States Patent [19]

Miyawaki et al.

[11] Patent Number: 4,539,043

[45] Date of Patent: Sep. 3, 1985

[54] BOTTOM-BLOWN GAS BLOWING NOZZLE

[75] Inventors: Yoshiharu Miyawaki, Tokyo; Masayuki Hanmyo, Fukuyama; Yusuke Shiratani, Fukuyama; Teruyuki Hasegawa, Fukuyama; Yoichi Nimura, Fukuyama; Noriyuki Hiraga, Fukuyama, all of Japan

[73] Assignee: Nippon Kokan Kabushiki Kaisha, Tokyo, Japan

[21] Appl. No.: 556,162

[22] PCT Filed: Mar. 29, 1983

[86] PCT No.: PCT/JP83/00098

§ 371 Date: Nov. 29, 1983

§ 102(e) Date: Nov. 29, 1983

[87] PCT Pub. No.: WO83/03427

PCT Pub. Date: Oct. 13, 1983

[30] Foreign Application Priority Data

| | | | |
|---|---|---|---|
| Mar. 29, 1982 | [JP] | Japan | 57-50545 |
| Mar. 29, 1982 | [JP] | Japan | 57-50546 |
| Mar. 29, 1982 | [JP] | Japan | 57-50547 |
| Mar. 29, 1982 | [JP] | Japan | 57-50548 |
| Mar. 29, 1982 | [JP] | Japan | 57-50549 |
| Mar. 29, 1982 | [JP] | Japan | 57-50550 |
| Mar. 29, 1982 | [JP] | Japan | 57-50551 |

[51] Int. Cl.[3] ..... C22B 7/16

[52] U.S. Cl. ..... 266/265; 75/59.1; 266/266; 266/270

[58] Field of Search ..... 75/59, 60; 266/265, 266/266, 270

[56] References Cited

U.S. PATENT DOCUMENTS

| | | | |
|---|---|---|---|
| 3,330,645 | 7/1967 | De Moustier | 75/60 |
| 3,971,548 | 7/1976 | Folgero | 266/265 |
| 4,438,907 | 3/1984 | Kimura | 266/265 |

FOREIGN PATENT DOCUMENTS

| | | |
|---|---|---|
| 57-116765 | 7/1982 | Japan . |
| 58-34943 | 3/1983 | Japan . |
| 58-37110 | 3/1983 | Japan . |

*Primary Examiner*—Peter D. Rosenberg

*Attorney, Agent, or Firm*—Fleit, Jacobson, Cohn & Price

[57] ABSTRACT

The object is to introduce a bottom-blown gas into a molten metal refining furnace so as to minimize the rate of blowing gas flow and increase the control range of the rate of blowing gas flow. There are included a refractory (1) having a plurality of holes (2) having an inner diameter of from 0.5 to 3.0 mmϕ formed through said refractory and extending its working surface to its back, a metal cover (3) enclosing at least a part of the sides of the refractory (1) and a pressure box (4) formed in the bottom of the refractory (1) so as to communicate with the holes (2) and define a gas reservoir space. The molten metal is prevented from entering the holes (2) when the blowing gas pressure and the rate of blowing gas flow are decreased.

10 Claims, 41 Drawing Figures

BOTTOM-BLOWN GAS BLOWING NOZZLE

A first embodiment of the present invention relates to a molten metal refining nozzle which is mounted, for example, in the bottom of a molten metal refining furnace for blowing gas therethrough and its object is to increase the flow control range of the refining nozzle during the gas blowing and also to increase the service life of the nozzle itself.

It is well known in the art that for the purpose, for example, of refining, degassing or stirring molten metal, gas blowing refractory nozzles are mounted mainly in the bottom of a molten metal vessel and various kinds of gases are blown into the molten metal through the nozzles. Also, recently it has been made known to blow gas into a refining furnace, such as a converter, through its bottom by means of the gas blowing nozzles made of refractory material and the nozzles for this purpose have been proposed by the group of inventors, etc., in Japanese Patent Application No. 56-84321 and Japanese Utility Model Application No. 56-125950.

However, the later investigations of these proposed nozzles have shown that the following problems are encountered.

(i) In the case of a gas blowing refractory formed with a large number of holes therethrough, the melting loss of the nozzle refractory increases with decrease in the spacing between the holes.

(ii) Where each of the holes in the gas blowing refractory is provided by a steel tube embedded in the refractory, the steel tubes will be crushed during the manufacture if the wall thickness is thin and the melting loss will be increased during the use if the wall thickness is large.

(iii) In the case of an equipment including a pressure box in the lower part of the gas blowing refractory, the flow of the blown gas will be deteriorated and the melting loss will be increased if the distance between the upper and lower steel plates forming the pressure box is too small.

(iv) The service life and manufacturing cost of the nozzle will be affected adversely if the thickness of the metal cover enclosing the sides of the gas blowing refractory is not proper.

(v) If the chemical composition of the gas blowing refractory is not proper, the penetration of the molten steel and slag will increase and also the damage due to thermal spalling will be increased.

The first embodiment of the invention is intended to solve the foregoing unsolved problems of the molten metal refining nozzles for gas blowing purposes and it provides a measure for overcoming each of these problems.

The subject matter of the first embodiment of the invention resides in a molten metal refining nozzle comprising a refractory having a plurality of holes extending from its working surface to its back, a metal cover enclosing the sides of the refractory, and a pressure box provided in the bottom of the refractory so as to communicate with the holes and define a gas reservoir space.

Another feature of the first embodiment of the invention is that the spacing between the plurality of holes in the refractory is selected not less than 3 mm and not greater than 150 mm.

Still another feature of the first embodiment of the invention is that each of the plurality of holes in the refractory is provided by a metal tube embedded in the refractory and the wall thickness of the metal tubes is selected as not less than 0.1 mm and not greater than 10 mm.

Still another feature of the first embodiment of the invention is that the metal cover comprises a steel plate having a thickness of not less than 0.1 mm and not greater than 5 mm.

Still another feature of the first embodiment of the invention is that the distance between the upper and lower metal plates defining the gas reservoir space of the pressure box is selected as not less than 2 mm and not greater than 50 mm.

BRIEF DESCRIPTION OF THE DRAWINGS

FIG. 7-1 is a longitudinal sectional view showing an example of a molten metal refining nozzle according to a second embodiment of the invention.

FIG. 7-2 is a plan view of the nozzle.

FIG. 15-1 is a perspective view of a nozzle according to a third embodiment of the invention.

FIG. 15-2 is a sectional view of FIG. 15-1.

(1) refractory made of nonporous brick, (2) nozzle hole, (2') nozzle hole arranged on outer side, (2'') nozzle hole arranged on inner side, (3) metal cover, (4) pressure box, (5) upper metal plate, (6) lower metal plate, (7) gas induction pipe, (8) outer sleeve, (9) set brick, (10) vessel shell, (11) porous refractory, (12) gas sealing coating material or shell, (13) bottom shell, (14) gas induction pipe, (15) small tube, (16) nonporous refractory nozzle, (17) gas pressure equalizing chamber, (18) gas sealing coating, (19) converter bottom, (20) mounting position of bottom blowing nozzle.

Figure 1:
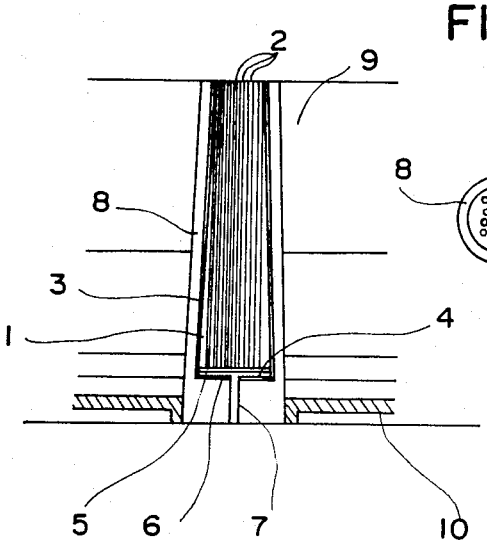
FIG. 1 is a longitudinal view showing an example of a molten metal refining nozzle according to a first embodiment of the invention.
Figure 2:
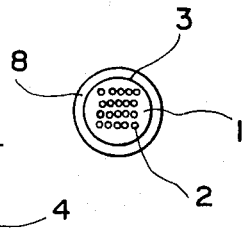
FIG. 2 is a plan view of the nozzle.

The molten metal refining nozzle according to the first embodiment of the invention will now be described with reference to the drawings. FIG. 1 is a longitudinal sectional view showing an example in which the molten metal refining nozzle according to the first embodiment of the invention is mounted in the bottom of a molten metal vessel, and FIG. 2 is a plan view of the molten metal refining nozzle. In the Figures, numeral (1) designates a refractory made of porous brick. The refractory (1) is formed with a plurality of holes (2) extending from its working surface or that surface which contacts with the molten metal on the inner side of the vessel when it is mounted in the molten metal vessel to its back or that surface outside of the vessel and the holes extend substantially straightly. Numeral (3) designates a metal cover constructed to enclose a part or the whole, i.e., at least a part, of the sides of the refractory (1). The lower end of the metal cover (3) extends through the lower end of the refractory (1) to define a gas reservoir space enclosed by an upper metal plate (5) and a lower metal plate (6). Note that the upper metal plate (5) is formed with a plurality of holes each communicating with one of the plurality of holes (2) at the contacting place therebetween and thus the blowing of gas is not impeded. Numeral (7) designates a gas induction pipe by which gas is blown into the molten metal vessel by way of the pressure box (4). Numeral (8) designates an outer sleeve provided to firmly mount the molten metal refining nozzle in a set brick (9) and a steel shell (10) of the molten metal vessel. Note that the outer sleeve is provided to prevent for example the breaking of the nozzle during the transport, etc.

The molten metal refining nozzle according to the first embodiment of the invention is constructed as described so far and the following requirements are further essential for the first embodiment of the invention to attain its objects.

One of the requirements is that the spacing between the holes (2) formed in the refractory (1) is selected not less than 3 mm and not greater than 150 mm.

By so doing, it is possible to greatly reduce the melting loss of the nozzle refractory which has heretofore been the problem in cases where the spacing between the holes is small as in the prior art nozzle refractories. The reason for selecting the spacing between 3 mm and 150 mm is that if the spacing does not exceed 3 mm, the previously mentioned effects cannot be obtained, whereas if the spacing is over 150 mm, the area occupied by the holes (2) is too small compared with the area of the refractory (1) and hence the amount of gas blown is reduced with the resulting decrease in the control range of flow rate.

Another requirement is that if the plurality of holes (2) in the refractory (1) are each composed of a metal tube embedded in the refractory (1), the wall thickness of the metal tubes is selected not less than 0.1 mm and not greater than 10 mm.

In this way, it is possible to prevent crushing of the metal tubes during manufacture, which occurs frequently when the wall thickness of the metal tubes does not exceeding 0.1 mm, and, it is also possible to prevent the melting loss from being increased due to the embedding of the metal tubes when the wall thickness exceeds 10 mm.

Another requirement is that the metal cover (3) be made of a steel plate having a thickness of not less than 0.1 mm and not greater than 5 mm.

In this way, it is possible to ensure the essential functions of the metal cover (3), that is, the prevention of gas leakage from the sides of the refractory (1) other than the holes (2) and the pressure loss of the blow gas. To ensure these functions and the desired service life of the nozzle, the lower limit for the thickness of the steel plate of a suitable material must be selected to be 0.1 mm and the upper limit must be selected to be 5 mm in order to prevent an increase in the manufacturing cost of the nozzle.

Another requirement is that the distance between the upper and lower steel plates (5) and (6) defining the gas reservoir space of the pressure box (4) be selected to be not less than 2 mm and not greater than 50 mm.

Thus, in order to overcome the prior art problems, that is, the deterioration of the blown gas flow, as well as the reduced flow control range and the increased pressure loss due to the excessively small distance between the upper and lower steel plates, it is necessary to select the lower limit of the distance to be 2 mm, and, it is also necessary to select the upper limit as 5 mm, in order to make the nozzle compact.

By so doing, it is possible to overcome the problem of the increased slag penetration due to the improper chemical composition of the conventional gas blowing refractory, the problem of the increased damage due to the thermal spalling, etc. Then, the lower limit for the carbon content in the chemical composition is selected as 5%, because the penetration of the molten metal and the slag increases, and the melting loss of the refractory increases, if the carbon content is less than this value, and, also, the reason for selecting the upper limit as 30%, is that the strength and corrosion resistance of the refractory deteriorate if the carbon content is greater than this upper limit.

The following Table 1 shows an example in which 641 channels of the molten metal refining nozzle according to the first embodiment were used for the combined blow refining (the top and bottom flowing) in a converter. As will be seen from Table 1, the yield is improved by 0.59% over the refining using only the top blowing and the example is also effective with respect to the ferroalloys. The other effects are the reduced refining time, the reduced tapping temperature, etc. It will be seen from the Table that as regards the rate of refractory melting loss, the rate of melting loss of the conventional porous nozzle with the gas ventilation holes of 100$\mu$ or less is 2.5 to 5.0 mm/ch, while the rate of melting loss is as small as 0.8 to 0.9 mm/ch when the nozzle according to the first embodiment of the invention comprise a nonporous brick nozzle formed with holes of about 1 mm$\phi$.

TABLE 1

| Major item | Item | Comparison First embodiment (design) | Prior art | Effect |
|---|---|---|---|---|
| Metallurgical properties | End point | | | |
| | [C]% | 0.040 | 0.038 | |
| | [Mn]% | 0.17 | 0.11 | +0.03 |
| | [P]% | 0.011 | 0.010 | |
| | [O]ppm | 630 | 850 | Δ250 |
| | Slag [T.Fe]content % | 18.5 | 23.5 | Δ4.0 |
| | Ingot steel P content % | 0.0135 | 0.0135 | Δ0.0009 |
| Auxiliary material | Lime (Kg/T) | Same as top blowing | 45.74 | Δ1.38 |
| | Fluorite (Kg/T) | " | 0.04 | +0.04 |
| | Cooling agent (Kg/T) | Δ6.57 Kg/T with respect to top blowing | 30.74 | +4.13 |
| Ferrous alloy | FMn (Kg/T) | 0.44 | 1.33 | Δ0.34 |
| | (Mn nitride) | | (0.11) | (Δ0.11) |
| | Al | 1.81 | 2.06 | Δ0.24 |
| Production | Blow refining time (min) | Same as top blowing | 20.4 | Δ1.6 |
| | (Oxygen unit)($Nm^3$/T) | | (50.9) | (Δ2.7) |
| | Steel making time (min) | " | 40.3 | Δ4.7 |
| Temperature | Tapping temperature (°C.) | +5 with respect to top blowing | 1653.1 | Δ8.4 |
| Yield | % | +0.59 | Standard | +0.44 |
| Refractory (bottom blowing nozzle) | Rate of melting loss (mm/ch) | 0.9 | | |

Figure 3:
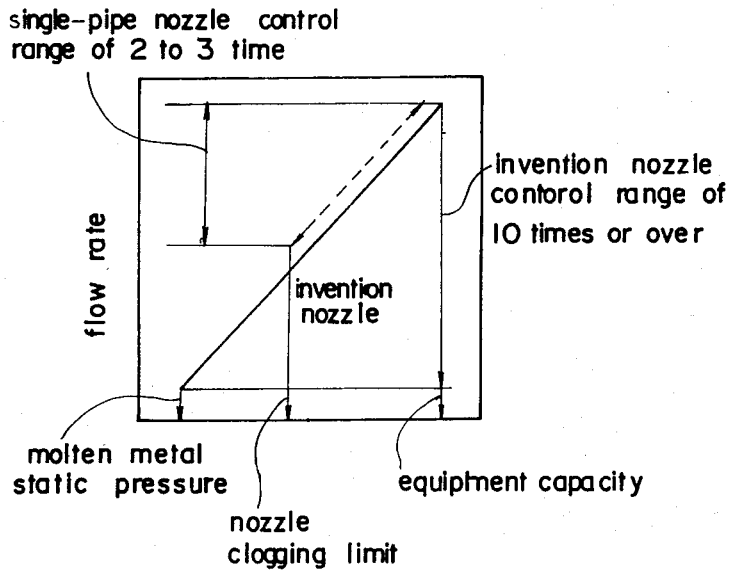
FIG. 3 is a graph showing a flow control characteristic of the nozzle according to the first embodiment of the invention.

FIG. 3 is a graph showing a blown-gas flow control characteristic of the nozzle according to the first embodiment of the invention.

Figure 4:
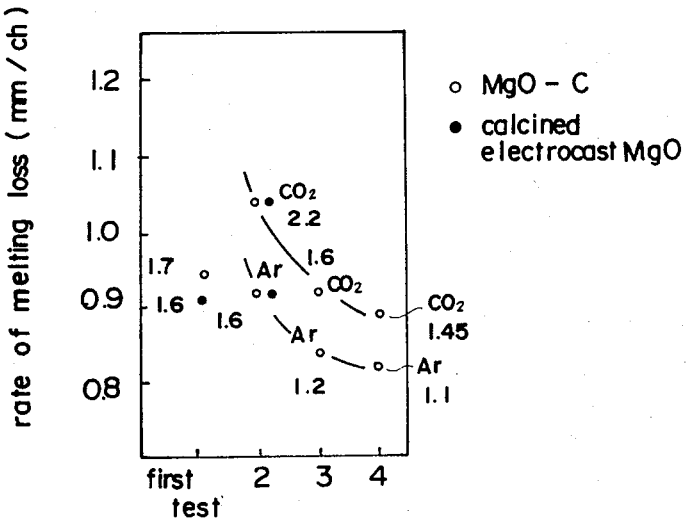
FIG. 4 is a graph showing changes in the rate of melting loss of the nozzle.
Figure 6:
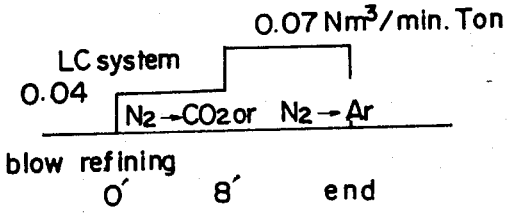
FIG. 6 is a graph showing the bottom blowing pattern in the tests the data of which are shown in FIG. 4.

FIG. 4 is a graph showing the course of changes in the service life of the nozzle when the refining was effected under the use conditions: the nozzle material, MgO—C (C 20%); bottom blowing gas pressure, 4 to 20 Kg/$Cm^2$ G; flow rate, 10 to 200 $Nm^3$/Hr; and types of gas, Ar, $Co_2$ and $N_2$ and the operating conditions: the tapping temperature, 1,680° to 1,685° C.; and the bottom blowing pattern, as shown in FIG. 6.

FIG. 6 is a graph showing the relationship between the tapping temperature and the rate of melting loss.

Figure 5:
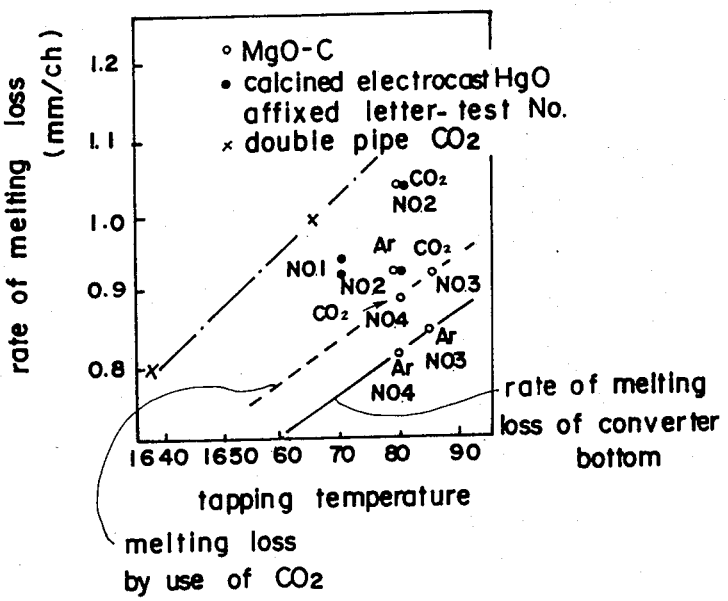
FIG. 5 is a graph showing the relationship between the rate of melting loss of the nozzle and the tapping temperature.

In the case of FIGS. 4 and 5, the rate of melting loss is greater when the bottom-blown gas is $CO_2$ than when the gas is Ar on the following grounds $$Fe(l)+CO_2(g)\rightarrow FeO+CO \quad \text{(i)}$$

$$FeO+C\ (\text{in MgO—C})\rightarrow Fe(l)+CO$$

$$(FeO)+C\ (\text{in MgO—C})\rightarrow Fe(l)+CO \quad \text{(ii)}$$

It is considered that the carbon in MgO—C is reduced by FeO and thus MgO is directly lost by melting. (The Fe(l) layer of 0.5 to 1.0 mm is present on the working surface.)

As a result, in accordance with the first embodiment of the invention, considerations are given, such as, the addition of a proper amount of carbon to C in the MgO—C, the improvement of the purity of C (95 to 99%) and the improvement of the purity of MgO.

As will be apparent from the above-described example, in accordance with the molten metal refining nozzle of the first embodiment of the invention a wide range of flow control is possible for the blowing of gas, thereby not only improving the refining effect, but also increasing the service life of the nozzle itself.

A second embodiment of the invention relates to a molten metal refining nozzle, which is mounted in the bottom or the like of a molten metal refining furnace to blow gas therethrough and its object is to increase the range of flow control for the blowing of gas by the refining nozzle and also to increase the service life of the nozzle itself.

It is well known in the art that, for the purpose, for example, of refining, degassing or stirring molten metal, gas blowing refractory nozzles are mounted mainly in the bottom of a molten metal vessel and various kinds of gases are blown into the molten metal through the nozzles. Also, recently, it has been made known to blow gas into a refining furnace, such as a converter, through its bottom by means of gas blowing nozzles made of refractory material and the nozzles for this purpose have been proposed by the group of the inventors, etc., in Japanese Patent Application No. 56-84321 and Japanese Utility Model Application No. 56-125950.

However, the following problems have been found by further investigations of the proposed nozzles.

(i) Where the holes in the gas blowing refractory are all substantially equal in diameter, the mushroom formed on the working surface (the layer of the vessel molten metal covering in mushroom shape along the working surface in front of the holes ) becomes unstable in shape, the melting loss is increased, the gas blowing direction becomes unsteady and the control range of the gas flow rate is decreased thus tending to cause clogging of the holes.

The second embodiment of the invention is intended to solve the foregoing unsolved problems of the molten metal refining nozzle for gas blowing purposes and it provides measures to overcome these problems.

The subject matter of the second embodiment of the present invention resides in a molten metal refining nozzle for blowing a bottom-blown gas through a plurality of holes formed in a refractory which extend from its working surface to its back, the plurality of the holes in the refractory being such that those arranged on the outer side are smaller in diameter than the others arranged on the inner side.

Figures 1, 7:
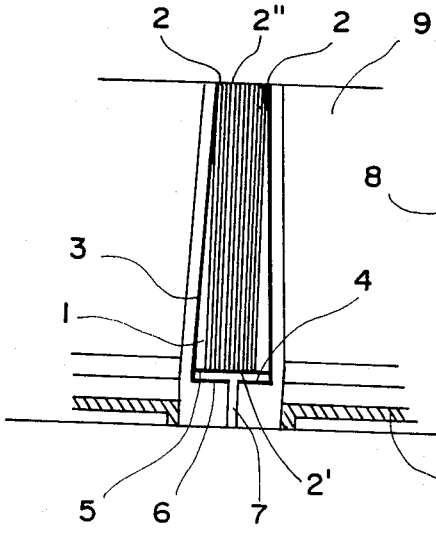
Figures 2, 7:
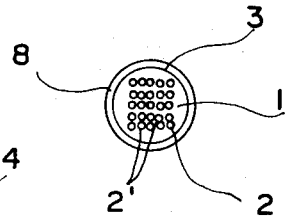

The molten metal refining nozzle according to the second embodiment of the invention will now be described with reference to the drawings. FIG. 7-1 is a longitudinal sectional view showing an example in which the molten metal refining nozzle according to the second embodiment of the invention is mounted in the bottom of a molten metal vessel, and FIG. 7-2 is a plan view of the molten metal refining nozzle shown in FIG. 7-1. In the Figures, numeral (1) designates a refractory made of nonporous brick. The refractory (1) is formed with a plurality of holes (2) extending substantially straightly from its working surface or that surface which directly contacts with the molten steel on the inner side of the vessel when it is mounted in the molten metal vessel to its back or the other surface on the outer side of the vessel. Numeral (3) designates a metal cover which is constructed to enclose the sides of the refractory (1). The lower end of the metal cover (3) is extended beyond the lower end of the refractory (1) to define a gas reservoir space enclosed by an upper metal plate (5) and a lower metal plate (6). Note that the upper metal plate (5) is formed with a plurality of holes which are each in communication with one of the holes (2) at the contacting place therewith and thus the blowing of gas is not impeded at all. In accordance with the second embodiment of the invention, there is a feature that the holes (2) are divided into holes (2') having a smaller diameter and arranged on the outer side and holes (2'') having a larger diameter and arranged on the inner side. Numeral (7) designates a gas induction pipe through which gas is blown into the molten metal vessel via the pressure box (4). Numeral (8) designates an outer sleeve for firmly mounting the molten metal refining nozzle in a set brick (9) and a shell (10) of the molten metal vessel.

Figure 8:
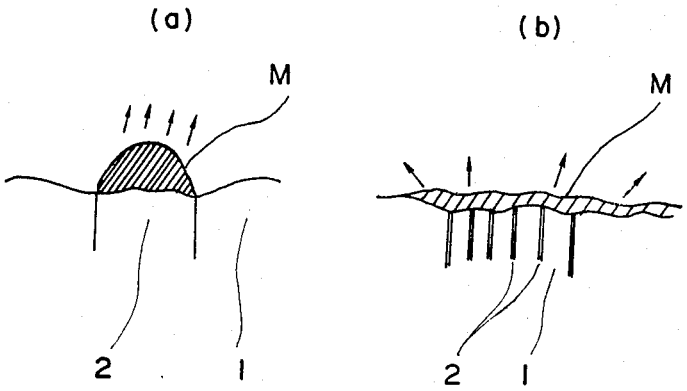
FIG. 8 shows sectional views showing the conditions of mushrooms produced by the molten material in the vessel at the front of the nozzle holes.

Thus, since the molten metal refining nozzle in accordance with the second embodiment of the invention is constructed as described above and the holes (2') arranged on the outer side are smaller in diameter than the holes (2'') arranged on the inner side, it is possible to overcome the disadvantages of the nozzle where the holes (2) are of substantially the same diameter, that is, the shape of the mushroom on the working surface (the layer formed in mushroom shape by the molten material in the vessel along the working surface in front of the holes) becomes unstable in shape so that the resulting melting loss increases and the direction of blowing becomes unstable. In other words, mushroom will take an ideal form when a refractory having a hole of the double pipe construction of FIG. 8(*a*) (the outer pipe passes a cooling gas and the inner pipe passes an intended gas) is used such that the molten material (M) in the vessel forms a layer of mushroom shape on the working surface in front of the hole and the blowing gas is introduced in the directions of the arrows shown in the Figure. However, where the holes (2) have substantially the same diameter as shown in FIG. 8(*b*), the molten material (M) in the vessel forms a layer of an unstable shape so that there is the danger of the holes (2) being clogged and there is also the danger of the gas being blown unstably as indicated by the arrows in the Figure. On the contrary, by selecting the diameter of the holes (2') arranged on the outer side smaller than that of the holes (2'') on the inner side, it is possible to form a mushroom which on the whole has substantially the same thickness and the introduced gas flows in a uniform direction thus preventing clogging of the holes and increasing the control range of flow rate.

Compared with a nozzle of the type in which a plurality of holes of the same diameter are formed in a nonporous refractory, the nozzle according to the second form of the invention has a very slow rate of melting loss and is capable of a wider range of flow control during the gas blowing thereby not only improving the refining effect but also further increasing the service life of the nozzle itself. A third embodiment of the present invention relates to a nozzle adapted for installation on a stationary large molten metal vessel of the continuous blowing type so as to blow gas into the molten metal contained in the vessel and a method for manufacturing the same.

Figure 9:
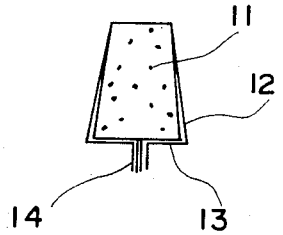
FIGS. 9 and 10 are sectional views of prior art porous plugs in the third embodiment of the invention.
Figure 10:
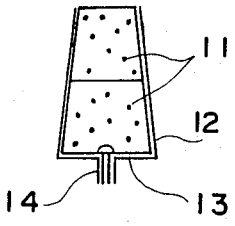

In the past, as regards nozzles adapted for blowing gas into the molten metal in molten metal vessels, porous plugs (each comprising a porous refractory having a gas induction pipe attached thereto) or special devices which will be described later are used in the case of travel type vessels. FIGS. 9 and 10 are sectional views of these porous plugs in which numeral (11) designate porous refractories, (12) gas sealing coatings or shells, (13) bottom shells, and (14) gas induction pipes.

Figure 11:
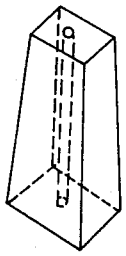
FIGS. 11, 12 and 13 are perspective views of conventional nozzle holes.
Figures 1, 12:
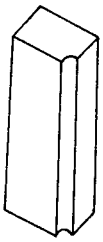
Figures 2, 12:
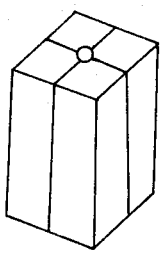
Figures 1, 13:
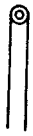
Figures 2, 13:
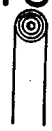

Also, in the case of stationary type vessels, as is the case with those used by such companies as AOD, RH and CLU, a hole is formed through a refractory (see FIG. 11), refractories are assembled to form a hole therethrough (see FIGS. 12-1 and 12-2) or a single or double tube is embedded in a refractory to blow gas through the openings thereof (see FIGS. 13-1 and 13-2).

Figures 1, 15:
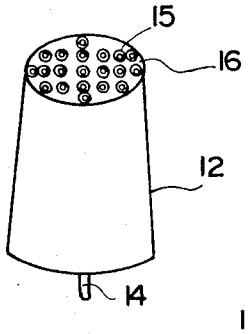
Figures 2, 15:
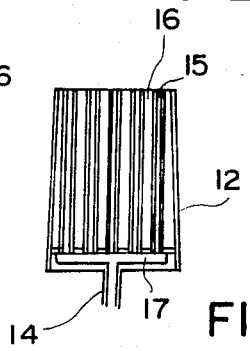
Figure 14:
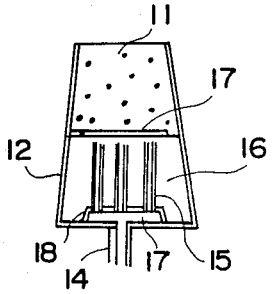
FIG. 14 is a sectional view of a conventional nozzle used in a transport vessel.

On the other hand, nozzles adapted for use with the travel type vessels include a nozzle of the construction shown in FIGS. 15-1 and 15-2. FIG. 14 shows the previously mentioned special device used with the travel type vessels. In FIG. 14, the parts designated by the same reference numerals as FIGS. 9 and 10 indicate that they comprise the same component parts. Numeral (15) designates small pipes, (16) a nonporous refractory nozzle, (17) a gas pressure equalizing chamber, and (18) a gas sealing coating or shell.

Since the conventional porous plug causes gas to pass through the pores in the brick structure, its gas flow rate is low and its melting loss resisting property also cannot be said as excellent. There is another disadvantage that since the plug is wholly composed of a refractory, the occurrence of spallings, cracks or the like tends to cause a variation in the gas flow rate and it is also difficult to manufacture large gas blowing bricks.

As a result, a gas blowing nozzle having metal tubes embedded therein to provide holes therethrough can be said as one that can be used with a stationary type vessel whose vessel inner refractory has a service life of over several hundred times so as to be balanced in loss with other refractories and ensure a reduced variation in the gas flow rate.

Then, it is known that, as regards the relationship between the tubes for the holes and the blowing gas, if the type of gas and the gas pressure are fixed, the gas flow rate is proportional to the pipe diameter and the number of the tubes and flow resistance is presented if the tubes are long. While the gas flow rate is practically proportional to the sum of the bore cross-sectional areas of the tubes making it possible to ensure a large gas flow rate with a small number of large-diameter tubes, if the range of the required gas flow rates is large and use of low flow rates is needed, there are problems in that the molten metal tends to enter the large-diameter tubes with the result that the molten metal solidifies in the tubes or flows out through the tubes and so on.

The gas blowing nozzle according to the third embodiment of the invention has been made in view of these deficiencies to overcome the same. It comprises a refractory nozzle which is mounted on a stationary type molten metal vessel capable of continuous gas blowing so as to blow gas into the molten metal in the vessel and is constructed so that a large number of small tubes are provided in the nozzle to pass the gas therethrough.

Still another feature of the third embodiment of the invention is that the inner diameter of the small tubes is selected between 0.5 and 3.0 mm$\phi$.

Still another feature of the third embodiment of the invention is that the small tubes number between 10 and 150.

Another feature of the third form of the invention is that the nozzle comprises a plurality of unit nozzles in stages.

Still another feature of the third form of the invention is that the entire length of the nozzle (excluding the gas induction pipe) is selected to be 500 mm or over.

Figure 16:
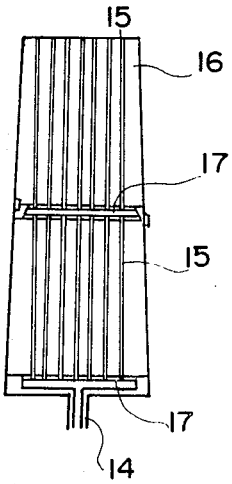
FIG. 16 is a sectional view showing an example of the third embodiment of the invention.

Next, the gas blowing nozzle according to the third embodiment of the invention will be described with reference to the drawings. In FIGS. 15-1 and 15-2, numeral (16) designates a nonporous refractory nozzle, and (15) a large number of small tubes disposed in the refractory nozzle to pass gas and each consisting of a heat-resisting steel tube such as a stainless steel tube. Numeral (17) designates a gas pressure equalizing chamber. While this portion must be filled with a stopping material when the conventional nozzle of FIG. 14 is used with a travel type vessel, the nozzle according to the third embodiment of the invention is used with a stationary vessel so that gas is blown without interruption and therefore no stopping material is needed. Numeral (12) designates a gas sealing coating or shell. FIG. 16 shows a nozzle including two units of the nozzle of FIG. 15 which are arranged one upon another.

While the third embodiment of the invention also features that the inner diameter of the small tubes (15) is selected to be from 0.5 to 3.0 mm in the above mentioned basic construction, this limitation of the inner diameter of the small tubes (15) is due to its dual function of preventing the entry of the molten metal into the small tubes (15) and ensuring the blowing of a large amount of gas and thus, if the diameter is not exceeding 0.5 mm, it is not preferable since the essential object of the small tubes (15) is not attained, that is, the flow rate of blowing gas is reduced excessively, while on the other hand, if the diameter is over 3.0 mm, the entry of the molten metal cannot be avoided.

The third embodiment of the invention also features the number of the small tubes (15) provided in the nonporous refractory nozzle (16) to be selected as 10 to 150. This limitation to the number of the small tubes (15) has the purpose of ensuring the blowing of the large amount of gas required for efficient refining in the molten metal vessel. Thus, the upper and lower limits to the number of tubes represent the optimum range for this purpose.

The third embodiment of the invention has another feature. The nozzle comprises a plurality of unit nozzles in stages. This limitation is provided so that different nozzles of given lengths are assembled in stages as the occasion demands, with resulting merits with respect to the flow rate of blowing gas, the service life, the manufacturing cost, etc.

The third embodiment of the invention has another feature. The entire length of the nozzle (excluding the gas induction pipe) is selected to be 500 mm or over. This limitation is due to the fact that the refractory lining of a stationary large molten metal vessel is as thick as over 500 mm and therefore it is necessary to prepare nozzles having a length of 1,000 mm or 1,500 mm.

The presses used for producing (forming) such long unitary type nozzles include the friction screw press, the hydraulic press, the isostatic press, etc. While a friction screw press of as large as 1,000 ton/cm$^2$ is available, the equipment cost of this type is excessively high and the size is also excessively large. Also, there is no hydraulic press having a capacity equivalent to the friction screw press, and, generally, it is considered that every ton of a friction screw press corresponds to every three tons of a hydraulic press, thus making it undesirable to use the hydraulic press.

On the other hand, the isostatic press is a forming machine whose capacity is about 1.5 ton/cm$^2$ at the maximum and a nozzle having a very high bulk density was produced by forming a refractory composition of MgO, 80% by weight, and C, 20% by weight, into a nozzle of 1,500 mm in length and disposing scatteringly-arranged small hole tubes in the refractory. The following table shows comparisons with use of a friction screw press of 1,000 ton/cm$^2$.

| Comparative Case No. | 1 | 2 | 3 |
|---|---|---|---|
| Type of press used | Isostatic press of 1.5 ton/cm$^2$ | Friction press of 1000 ton/cm$^2$ | Friction press of 1000 ton/cm$^2$ |
| Nozzle brick length (mm) | 1500 | 750 | 450 |
| Bulk density (specific gravity) | 2.85 | 2.90 | 2.93 |

Figure 17:
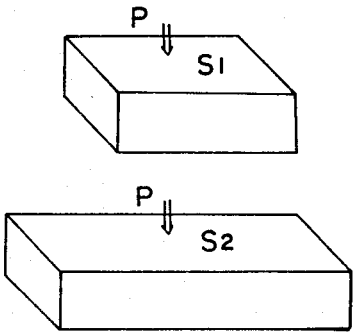
FIG. 17 is a diagram showing the relationship between the pressure of a press and the areas and densities of formed products.

In other words, in FIG. 17, if the areas to be formed are $S_1 < S_2$ and if the pressure P of the press is constant, then there results $P_1 > P_2$ in the case of the friction screw press.

Figure 18:
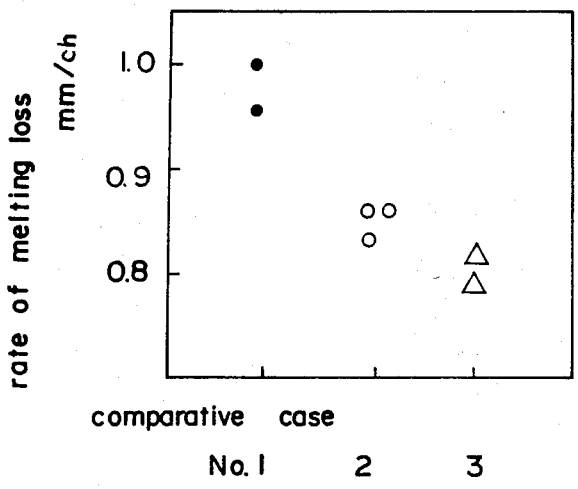
FIG. 18 is a graph showing the rate of melting loss of the example of the third embodiment of the invention.

FIG. 18 shows the examples in which the blowing nozzles of the comparative cases in the above table were fitted in the bottom of a 250-ton converter. As will be seen from the Figure, the comparative case 3 shows minimum rate of melting loss and the increased bulk density by the friction screw press has the effect of reducing the rate of melting loss.

In this connection, where the nozzle according to the third embodiment of the invention is constructed by assembling a plurality of unit nozzles in stages as shown in FIG. 16, it is a matter of course that separately formed refractories are connected by means of a gas equalizing chamber (17).

As compared with the long unitary construction nozzle, the assembled nozzle has a dense structure, reduces the decarbonization loss in the case of the previously mentioned MgO—C brick and improves the wear-resisting properties due to the intensified structure.

While a similar bulk density can be obtained by installing a press having a correspondingly increased size and capacity, the equipment cost is enormous and also an expenditure is needed for the maintenance of the drive. The third embodiment of the invention eliminates such cost and expenditure and also makes possible the production of an equivalent product.

A fourth embodiment of the invention relates to a nozzle refractory adapted for installation in the bottom or the like of a molten metal refining furnace so as to flow gas therethrough and its object is to increase the service life of the nozzle itself.

It is well known in the art that, for the purpose, for example, of refining degassing or stirring molten metal, gas blowing refractory nozzles are mounted mainly in the bottom of a molten metal refining furnace and various kinds of gases are blown into the molten metal through the nozzles. Also, recently it has been made known to blow gas into a refining furnace, such as a converter, through its bottom by means of gas blowing nozzles made of refractory material. Then, there is a problem that, if the chemical composition of the nozzle refractories is not proper, penetration of the molten metal and slag increases, and, also, damage due to the thermal spalling increases.

The fourth embodiment of the invention is intended to solve the unsolved problems of such molten metal refining nozzle refractories for gas blowing purposes.

In other words, the subject matter of the fourth embodiment of the invention resides in a molten metal refining nozzle refractory adapted for installation in the bottom or the like of a molten metal refining furnace, and the molten metal refining nozzle refractory has a chemical composition comprising C, 5 to 30%, and the remainder comprising one or more compounds selected from MgO, $Al_2O_3$, CaO, $Cr_2O_3$ and $ZrO_2$.

In accordance with the fourth embodiment of the invention, the carbon content in the chemical composition of the nozzle refractory is selected to be between 5 and 30% on the grounds that the lower limit of less than 5% not only increases the penetration of the slag with the resulting increase in the melting loss, but also increases the damage due to the thermal spalling, and the upper limit of over 30% deteriorates the nozzle in terms of the strength and corrosion resistance.

Also, in accordance with the fourth embodiment of the invention, the reason for including one or more of MgO, $Al_2O_3$, CaO, $Cr_2O_3$ and $ZrO_2$ in the chemical composition of the nozzle refractory is to improve the quality of the refractory and thereby improve the resistance to spalling, resistance to wear, strength, etc.

The raw materials used for the nozzle refractory are also shown as follows.

[Oxides] MgO, CaO, MgO.CaO, $ZrO_2$, $Al_2O_3$, $Cr_2O_3$, $MgO.Al_2O_3$;

[Carbon and carbides] C, Sic, ZrC, Wc, WoC, $B_4C$; and

[Nitrides] $Si_3N_4$, BN.

The fourth embodiment of the invention covers all of the calcined, uncalcined, and calcined and pitch impregnated nozzles using the above-mentioned ingredients as the principal components, and, in this case, the manufacturing method of refractory consists of the ordinary method.

With the nozzle refractory according to the fourth form of the invention, if the nozzle refractory is formed with a plurality of holes of about 1 mm, the rate of melting loss is reduced to as low as 0.8 to 0.9 mm/ch and hence the service life is increased.

A fifth embodiment of the invention relates to a refining method which makes possible, under the proper top and bottom blowing conditions, the refining of high carbon steel, which has heretofore been impossible with a top and bottom blowing converter due to the fact that the stirring by the bottom-blown gas is intense and it is impossible to ensure the (T.Fe) and oxygen potential in the slag, thus deteriorating the removal of phosphorus.

It is well known that, due to the recent increase in the size of top-blown converters, a so-called top and bottom blowing refining method is used in which gas is blown into the metal bath through the bottom of a converter so as to stir the metal bath and thereby improve the operating efficiency and the metallurgical performance.

On the other hand, the bottom blowing nozzles which have been put in practical use generally include the pipe type such as SUS pipes and the porous brick type.

In the case of the pipe type, generally the diameter is from 5 to 20 mm and the gas flow rate must be greater than the speed of sound at the outlets. If the flow rate is lower than this, nozzle clogging is caused. This is the essential condition that must be ensured so far as the molten metal is present. As regards the upper limit, the limit of the pressures used industrially in this type of process is on the order of 30 $Kg/cm^2$, and this range corresponds to the control range for the bottom-blown gases.

In other words, the lower limit of the bottom-blown gases is determined by nozzle clogging and the upper limit is determined by the equipment pressure limit. The range from the lower limit flow rate to the upper limit flow rate is about 2 to 3 times.

Metallurgically, as the bottom-blown gas flow rate is increased, the reaction of the molten metal and the slag is improved and dephosphorization is promoted. In the case of low carbon material (C=0.04% or less), the phosphorus content is decreased with an increase in the gas flow rate. In the case of high carbon material (C=0.40% or over), the slag and the metal are stirred excessively so that the oxidation potentials in the metal and the slag are decreased and dephosphorization is deteriorated greatly.

In the case of the known pipe type, the control range of the bottom-blown gases is narrow, and, therefore, there is the disadvantage that it is difficult to improve the effect in the high carbon range, although it is relatively easy to increase the effect in the low carbon range.

On the other hand, the porous nozzle type using porous brick is formed with a refractory material having its grain size controlled to come into a certain range, and, therefore, the gas vent holes are practically of 100$\mu$ or less. Therefore, even if the gas blow is stopped with the molten steel remaining in the converter, there is practically no entry of the molten metal into the pores and the previously mentioned problems of the pipe type are overcome.

In the case of the porous nozzle type, however, the gas flows through between the crystal grains of the refractory so that the resistance is very great there and the gas pressure must be maintained high in order to effect the gas control easily. If the gas pressure is increased, the nozzle is damaged greatly due to it being made of a refractory and the upper limit of the gas pressure is on the order of 30 $Kg/cm^2$. Also, the flow of the gas between the grains has the disadvantage of considerably deteriorating the service life of the porous nozzle itself.

The fifth embodiment of the invention has been made, in view of the foregoing deficiencies in the prior art, to overcome same, and, its subject matter resides in a method of producing high carbon steel by a top and bottom blowing converter in which nozzles each comprising a non-porous refractory formed with a large number of small-diameter holes are mounted in the bottom of the converter or in the furnace wall below the molten metal level and a bottom-blown gas of from 0.001 to 0.20 $Nm^3$/min.T is blown from the nozzles while maintaining a pressure higher than the molten steel plus slag static pressure.

Figure 19:
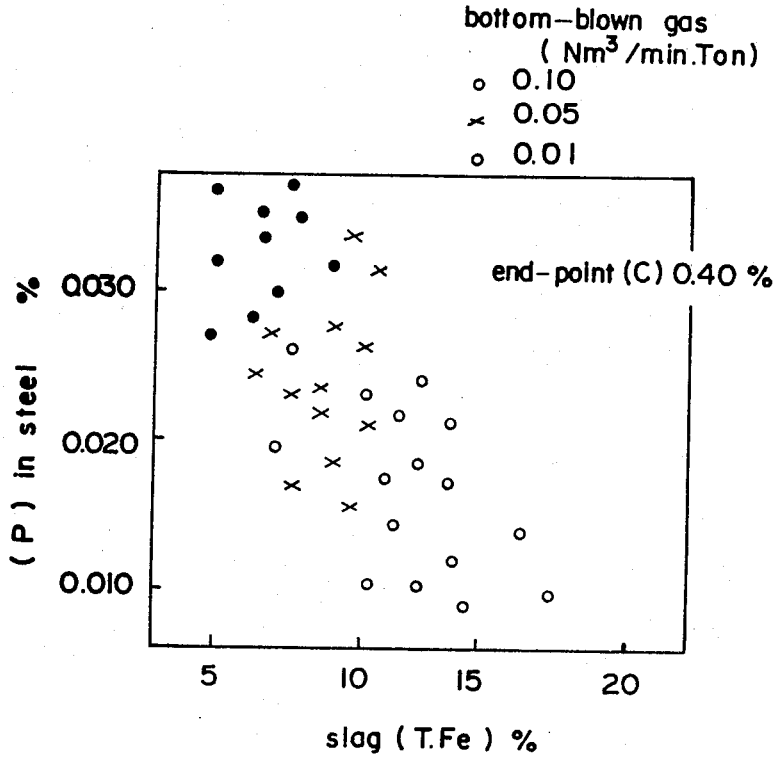
FIG. 19 is a graph showing the relationship between the flow rate of bottom-blown gas and the dephosphorization performance in a high carbon range according to fifth embodiment of the invention.

In accordance with the fifth embodiment of the invention there is provided an operating method which effects the refining by using nozzles of a particular type and blowing a particular amount of bottom-blown gas so as to promote the dephosphorization required for the production of steel by a top and bottom blowing converter and ensure the proper amount of (T.Fe) contained in the slag and the proper oxygen potential and which ensures 10% or more of the (T.Fe) content as shown in FIG. 19 and minimizes the amount of iron loss.

Figure 20:
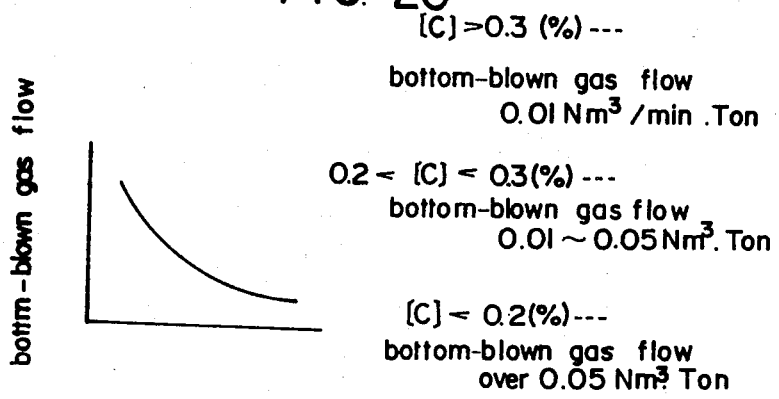
FIG. 20 is a graph showing the relationship between the end-point [C] level and the flow rate of bottom-blown gas.

More specifically, FIG. 19 is a graph showing the relationship between the flow rate of bottom-blown gas and the dephosphorization efficiency in the high carbon range. Also, FIG. 20 is a graph showing the optimum bottom-blown gas quantities in accordance with the end-point C levels.

In accordance with the fifth embodiment of the invention, the amount of bottom-blown gas required for the refining of high carbon steel is selected properly in accordance with the desired end-point carbon level on the basis of the technical details shown in the above Figures.

Figure 21:
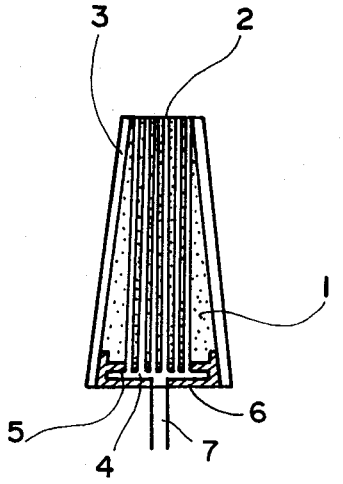
FIG. 21 is a sectional view showing an example of a bottom blowing nozzle used in the method according to the fifth embodiment of the invention.

FIG. 21 shows an example of a bottom blowing nozzle used with the refining method according to the fifth embodiment of the invention. In the Figure, numeral (1) designates a refractory made of nonporous brick, (2) a large number of small-diameter holes formed in the refractory (1) therethrough, (3) a metal cover comprising a shell covering the sides of the refractory (1), (4) a pressure box, (5) an upper metal plate, (6) a lower metal plate, (7) a gas induction pipe and (8) an outer sleeve (not shown).

Figure 22:
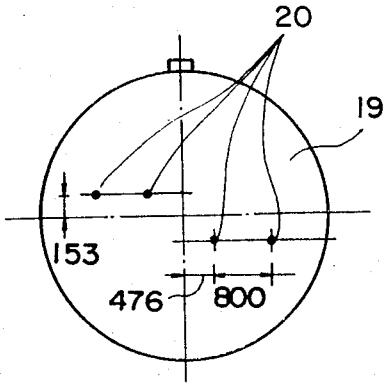
FIG. 22 is a plan view showing an example of the mounting positions of the bottom blowing nozzles in the bottom of a converter.

FIG. 22 shows an example of mounting positions of the above-mentioned nozzles in the converter bottom. In the Figure, numeral (19) designates the converter bottom, and (20) the mounting positions of the bottom blowing nozzles. Note that while the number of the nozzles is four in this case, the number of nozzles is not limited to four.

Figure 23:
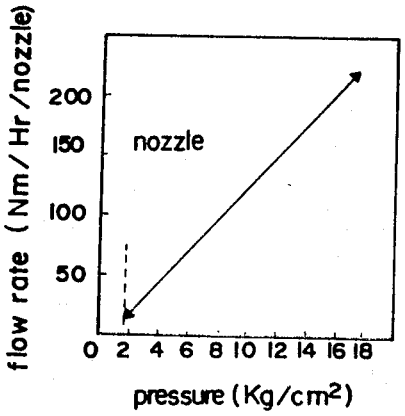
FIG. 23 is a graph showing the relationship between the flow rate and pressure of gas introduced from the bottom blowing nozzle.
Figure 24:
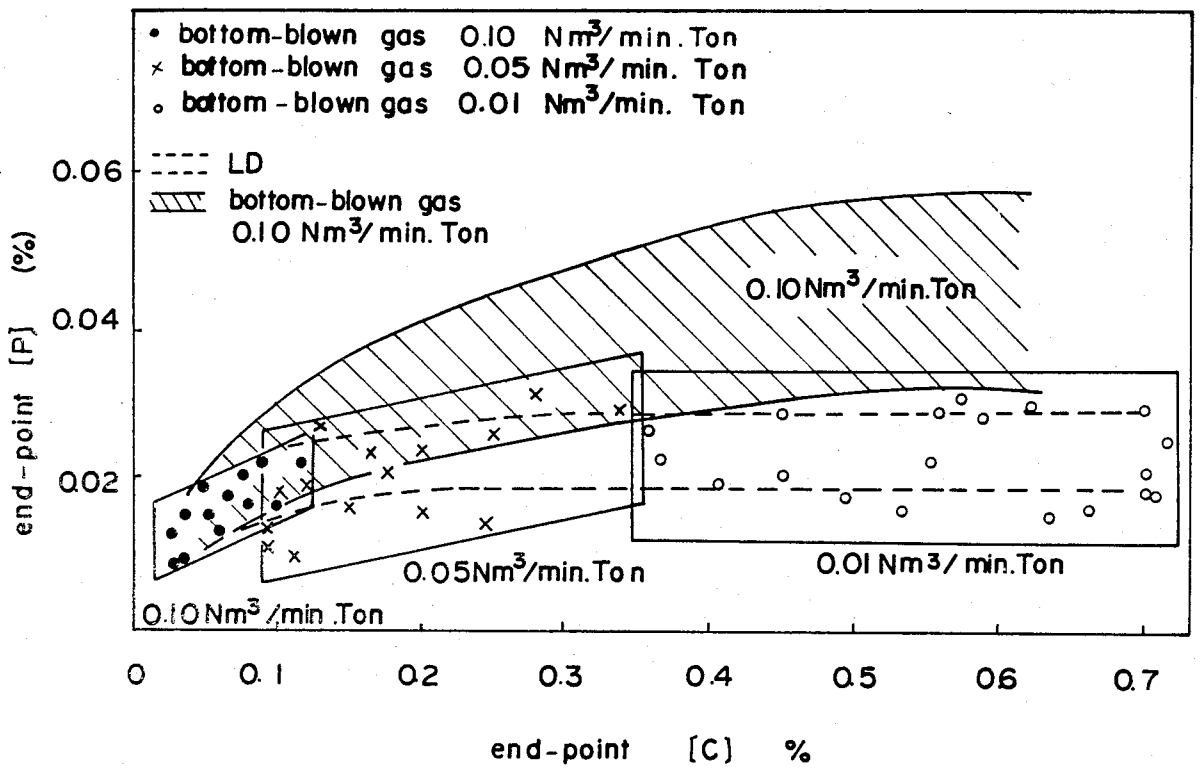
FIG. 24 is a graph showing the relationship between the flow rate of bottom-blown gas and the end-point [C] and [P] contents.
Figure 25:
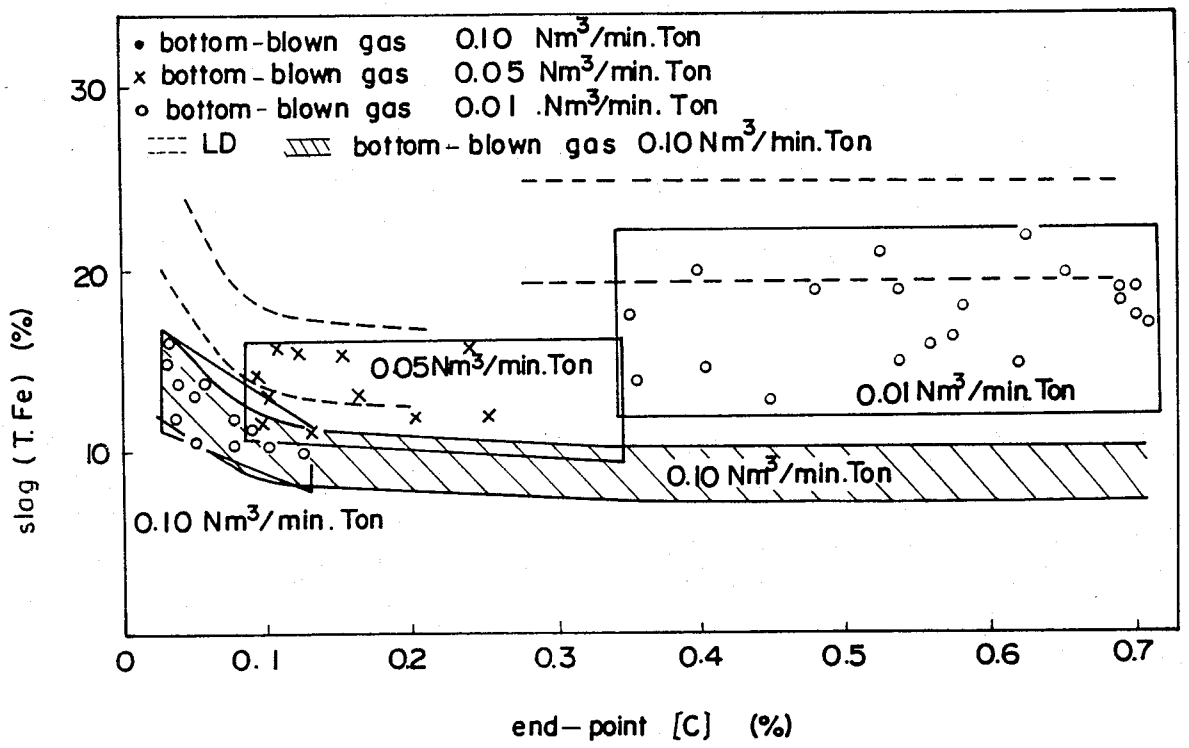
FIG. 25 is a graph showing the relationship between the flow rate of bottom-blown gas and the end-point [C] and T.Fe contents.

FIG. 23 is a graph showing a flow characteristic obtained when gas is blown into the converter through the bottom blowing nozzle, that is, the relationship between the pressure and flow rate of the blowing gas. FIG. 24 is a graph showing the relationship between the flow rate of bottom-blown gas and the end-point [C] and the end-point [P], and FIG. 25 is a graph showing the relationship between the flow rate of bottom-blown gas and the end-point [C] and T.Fe.

The following Table 2 shows by way of examples the materials and some details of the construction of the bottom blowing nozzles; Table 3 shows the bottom blowing conditions, and Table 4 shows a top-blown oxygen pattern and a bottom-blown pattern.

TABLE 2

| Material | Construction |
|---|---|
| Calcined-electro-casted MgO | 50 holes of 1.5 mmϕ, 1440 mm long |
| MgO—C | 50 SUS pipe holes of 1.5 mmϕ 1440 mm long |

TABLE 3

| Type of bottom-blown gas | Bottom-blown gas pressure | Bottom-blown gas flow rate (total flow of 4 nozzles) |
|---|---|---|
| $CO_2$, Ar, $N_2$ | 2–17 $Kg/cm^2$ | 0.003–0.06 $Nm^3$/min. Ton |

TABLE 4

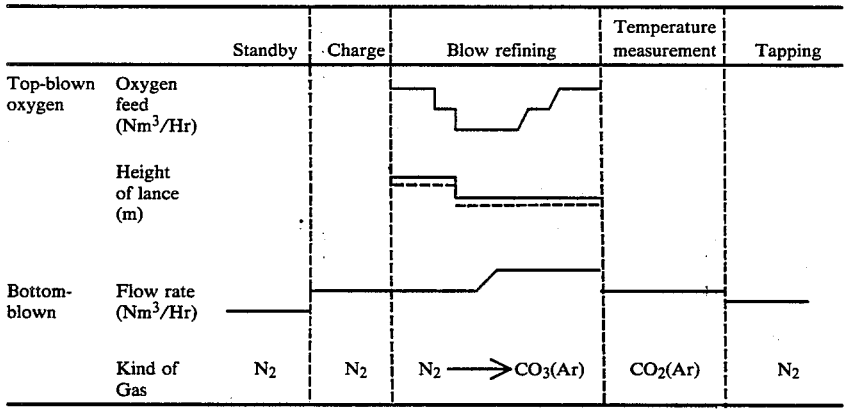

As will be seen from the above tables, in accordance with the method according to the fifth embodiment of the invention, it is possible to produce high carbon steel which has heretofore not been produced by the conventional top and bottom blowing converters.

A sixth embodiment of the invention relates to a novel method capable of controllng the nitrogen content of molten steel produced by a top and bottom blowing converter (combined blow refining) in the course of its refining.

On the other hand, a known method of controlling the nitrogen (N) content in ingot steel consists of detecting the level of nitrogen in the molten iron (the nitrogen level in the molten steel after the blow refining as the case may be) and charging FMn nitride during the tapping.

This known method is disadvantageous in that, actually, it is rather difficult to control the nitrogen content in the steel and it is also necessary to prepare the FMn nitride as a raw material.

The sixth embodiment of the invention is intended to solve the foregoing deficiencies and its subject matter resides in a method for controlling the nitrogen content of molten steel by a top and bottom blowing converter characterized in that the nitrogen level of the molten iron in the top and bottom blowing converter is detected (estimated in terms of the titanium [Ti] level of the molten iron) and a kind of bottom-blown gas is blown in place of a predetermined amount of nitrogen gas.

Figure 26:
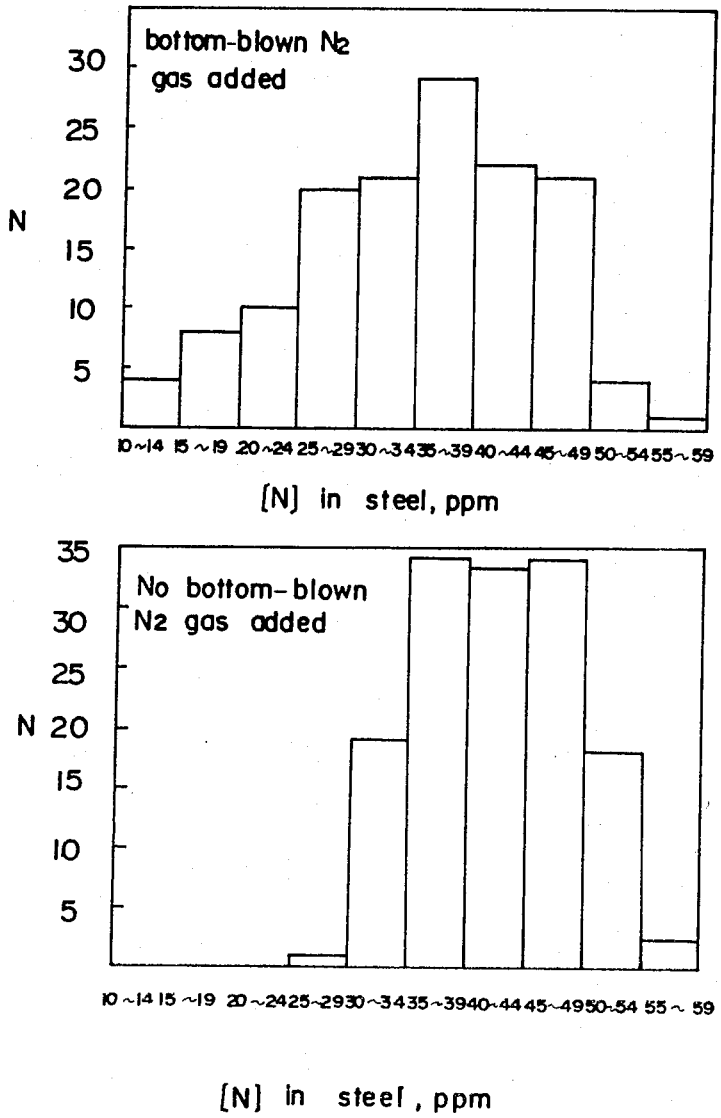
FIG. 26 is a graph showing an example of controlling the N content by the addition of $N_2$ gas in accordance with a sixth embodiment of the invention.

FIG. 26 shows the [N] contents of the ingot steel obtained by performing the combined blow refining in a converter on the basis of the [N] levels in the molten iron which were estimated in terms of the [Ti] levels in the molten iron.

| Molten iron [Ti] (%) | Bottom-blown [N] unit ($Nm^3/T$) |
|---|---|
| Ti ≦ 0.07 | 0.20 |
| 0.08 ≦ 0.12 | 0.24 |
| 0.12 ≦ Ti | 0.28 |

Figure 27:
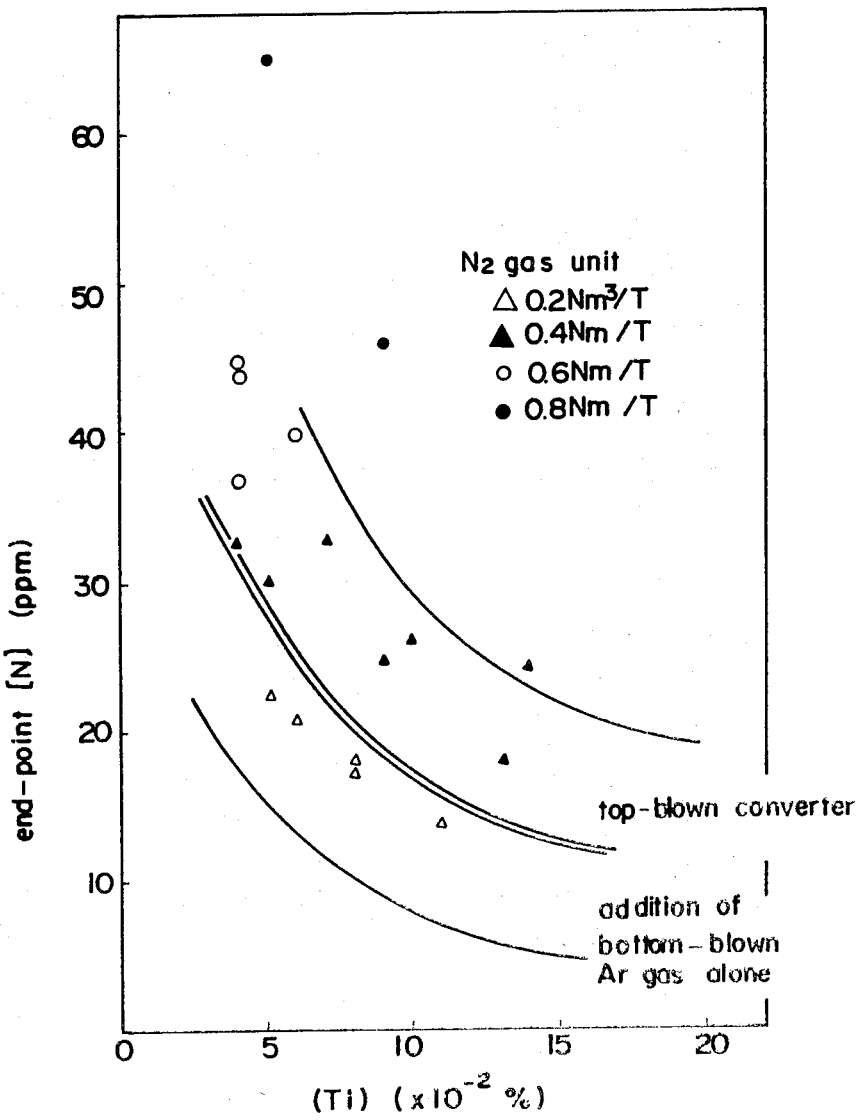
FIG. 27 is a graph showing the $N_2$ gas unit and the Ti % and [N] content.
Figure 28:
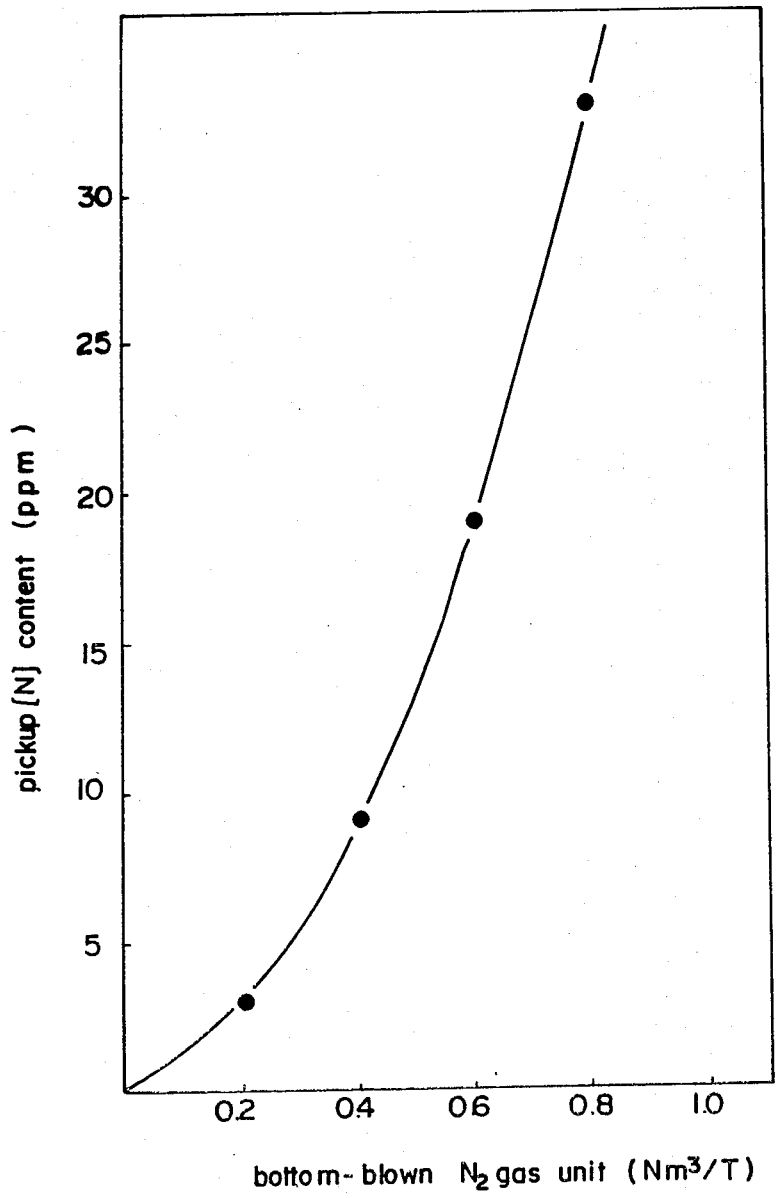
FIG. 28 is a graph showing the relationship between the $N_2$ gas unit and the amount of pickup [N] in an example of the sixth embodiment of the invention.
Figure 29:
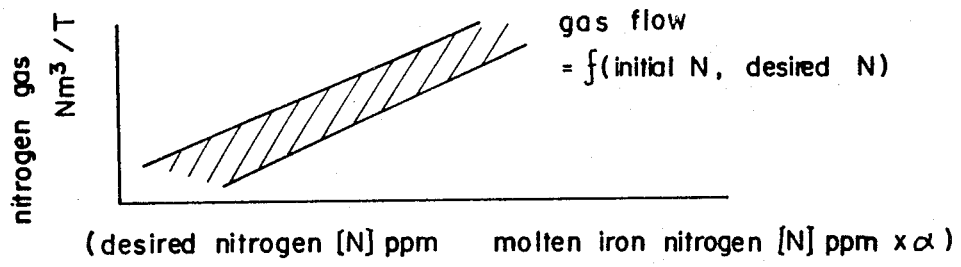
FIG. 29 is a graph showing the relationship between the (desired [N] content − [N] content of molten iron × converter denitration rate) and the blown nitrogen gas.

FIG. 27 shows the steel $N_{vp}$ (ppm) due to the blown $N_2$ gas, and FIG. 28 shows the relatinship between the blown $N_2$ gas unit and the pickup [N] quantity in accordance with the sixth embodiment of the invention. FIG. 29 shows the desired [N] ppm−molten iron [N] ppm×converter denitration factor and the nitrogen gas $Nm^3/T$. As will be seen from these Figures, the N content of the molten steel in the converter increases in proportion to the bottom blown $N_2$ gas unit.

On the other hand, the actual results showed that by supplying the bottom-blown gas entirely consisting of $N_2$ gas, during the refining it is possible to increase the [N] content of the molten steel in the furnace up to 65 ppm (Ti=0.04%) and its pickup quantity was 33 ppm in the case of the bottom-blown $N_2$ gas of 0.8 $Nm^2/TN_2$.

From these results, a relation for the addition of [N] by the bottom blowing of $N_2$ gas is obtained as follows; Pickup [N] quantity (ppm)$=\alpha\times N_2$ unit $(Nm^3/T)\beta$ (where $\alpha$ is a function (i.e., constant) in the range of 10 to 100, and $\beta$ is a function (i.e., constant) in the range of 1 to 5).

Due to the construction described so far in accordance with the method for controlling the nitrogen content of molten steel by a top and bottom blowing converter provided by the sixth embodiment of the invention, $N_2$ gas is used as the bottom-blown gas for the combined blow refining with the result that not only the control of the end-point [N] content is made possible in addition to the effect of the combined blow refining, but also the necessity for the introduction of FMn nitride is eliminated.

A seventh embodiment of the invention is designed so that the production of low phosphorus steel by converter refining, which has heretofore been effected by the double slag process (the initial slag is teemed and the refined slag is used as a new composition), is accomplished in a top and bottom blowing converter by the single slag process, thereby intending to reduce the steelmaking time.

The double slag process has heretofore been used to produce low phosphorus steel by converter blow refining, and this process also involves the following problems:

(i) The steelmaking time is as long as about 1.5 times that of the single slag process; and (ii) Due to the circumstance of (i) above, the melting loss of the converter furnace proper is promoted.

The seventh embodiment of the invention has been made in view of these problems to overcome same.

In other words, the subject matter of the seventh embodiment resides in a method of producing low phosphorus steel by a top and bottom blowing converter comprising maintaining the basicity ($CaO/SiO_2$) of the slag at 4.0 or over, keeping the flow rate of bottom-blown gas at 0.07 $Nm^3$/min ton or less from the beginning of blow refining until at least the carbon content of molten steel attains 0.4%, then, maintaining the flow rate of the bottom-blown gas at 0.05 $Nm^3$/min ton during the refining until the desired carbon content of the molten steel is reached, and effecting further blowing of the bottom-blown gas only after the completion of the blow refining, thereby promoting the removal of the phosphorus from the molten steel.

The seventh embodiment of the invention is an examination of the change-over from the conventional double slag product to the single slag product in accordance with the following dephosphorization equilibrium equation:

$$\log KP = 0.112\,(CaO) + 24000/T + 5\log(T.Fe) - 19.5.$$

Figure 30:
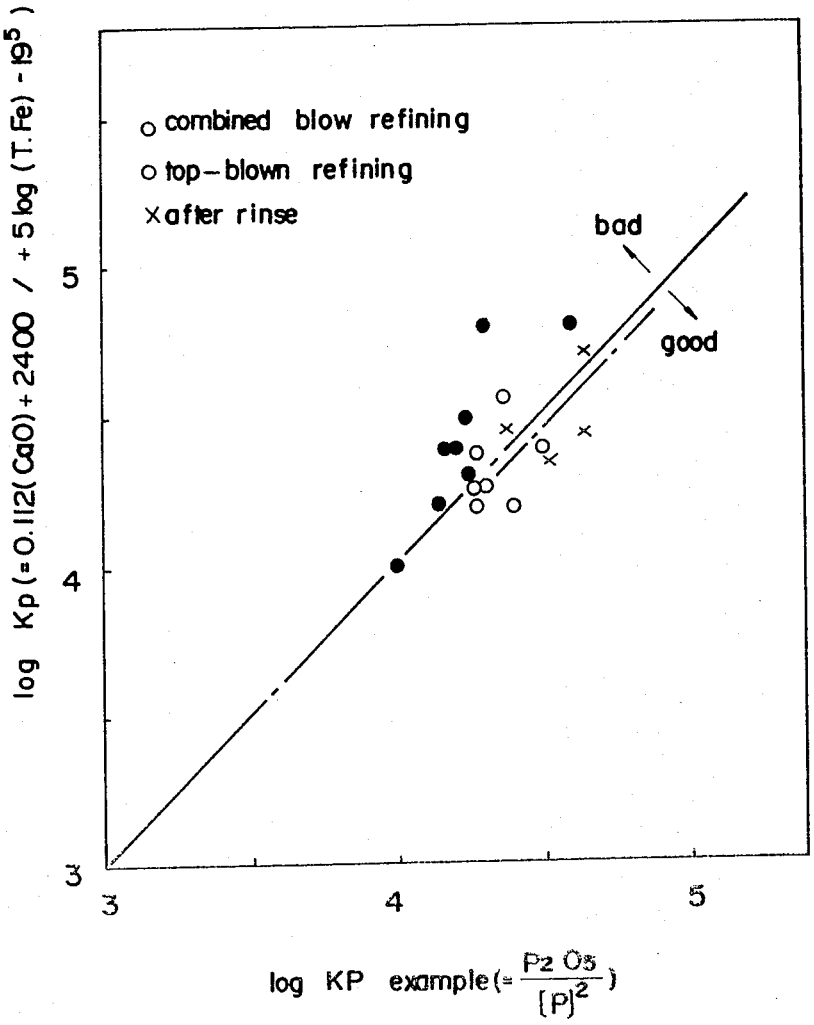
FIG. 30 is a graph showing the relationship between the actual results of the dephosphoration equilibrium by combined blow refining according to a seventh embodiment of the invention.

When the operating conditions of the top and bottom blowing converter (hereinafter referred to as a combined blow refining) were selected as follows, the dephosphorization equilibriums of the combined blow refining and the top blown converter (the relationship between the above equation and the actual result became as shown in FIG. 30).

| Operating conditions: | |
|---|---|
| (a) $V(CaO/SiO_2) = 5.0$ | (5.0 is the maximum according to the previous results) |
| slagging rate | 85% |
| (b) molten iron Si | 0.6% |
| (c) slag (T.Fe) | 25% |

Then, the calculation of the end-point [P] content is determined from the phosphorus balance in accordance with the following equation.

$$[P]\,vP = \frac{\sqrt{0.903 + 0.2393 \times KP \times [P]\text{ input}}}{0.1197\,KP} \quad (1)$$

Figure 31:
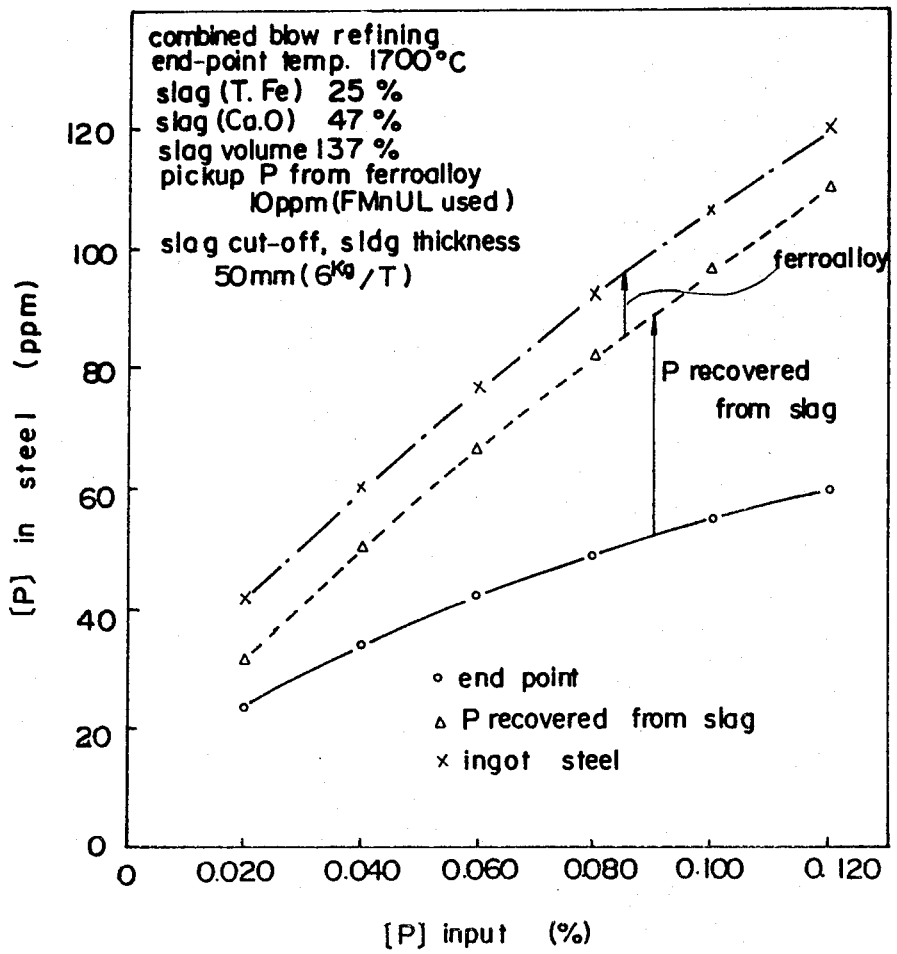
FIG. 31 is a graph showing the relationship between the [P] input and the [P] content of steel.

(Where [P] vP is the end-point [P] content, KP is $(P_2O_5)$/end-point [P] content, and [P] input is the molten iron [P]%+auxiliary material [P]%), and FIG. 31 shows the relationship between the [P] input and the end-point [P] content determined in accordance with the above equation (1).

Figure 32:
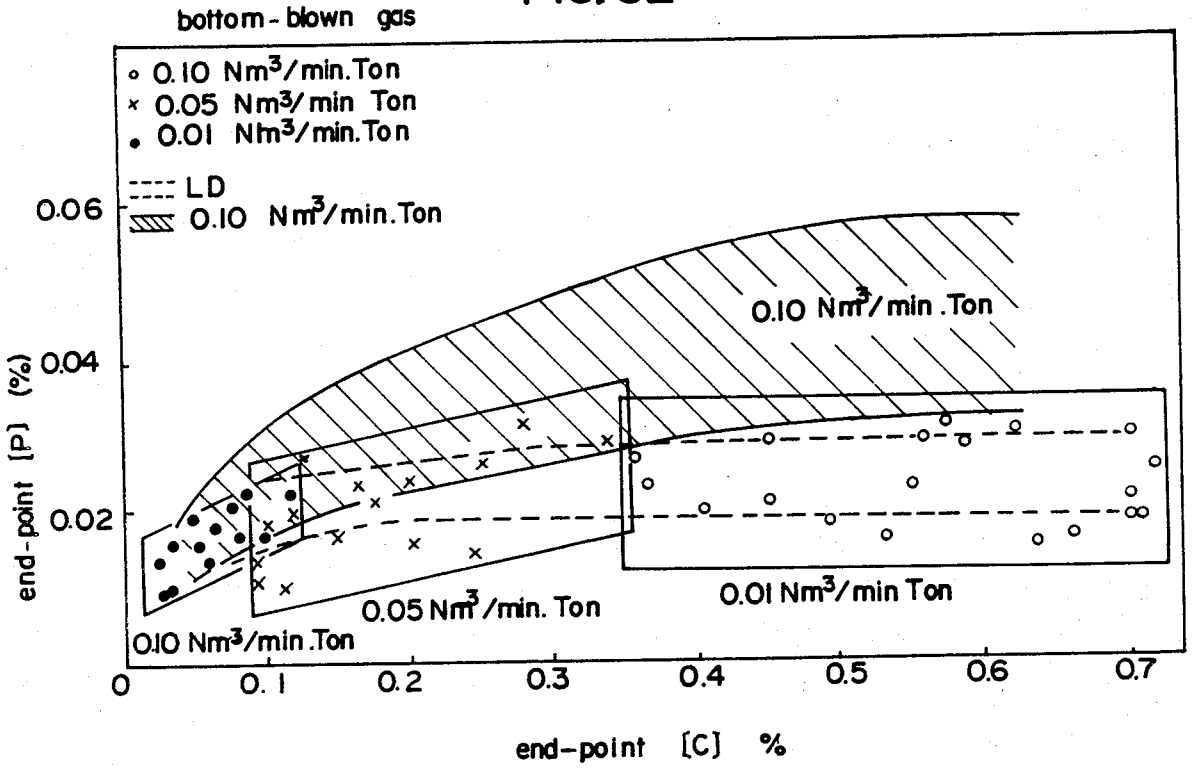
FIG. 32 is a graph showing the relationship between the flow rate of bottom-blown gas and the end-point [C] and the end point.
Figure 33:
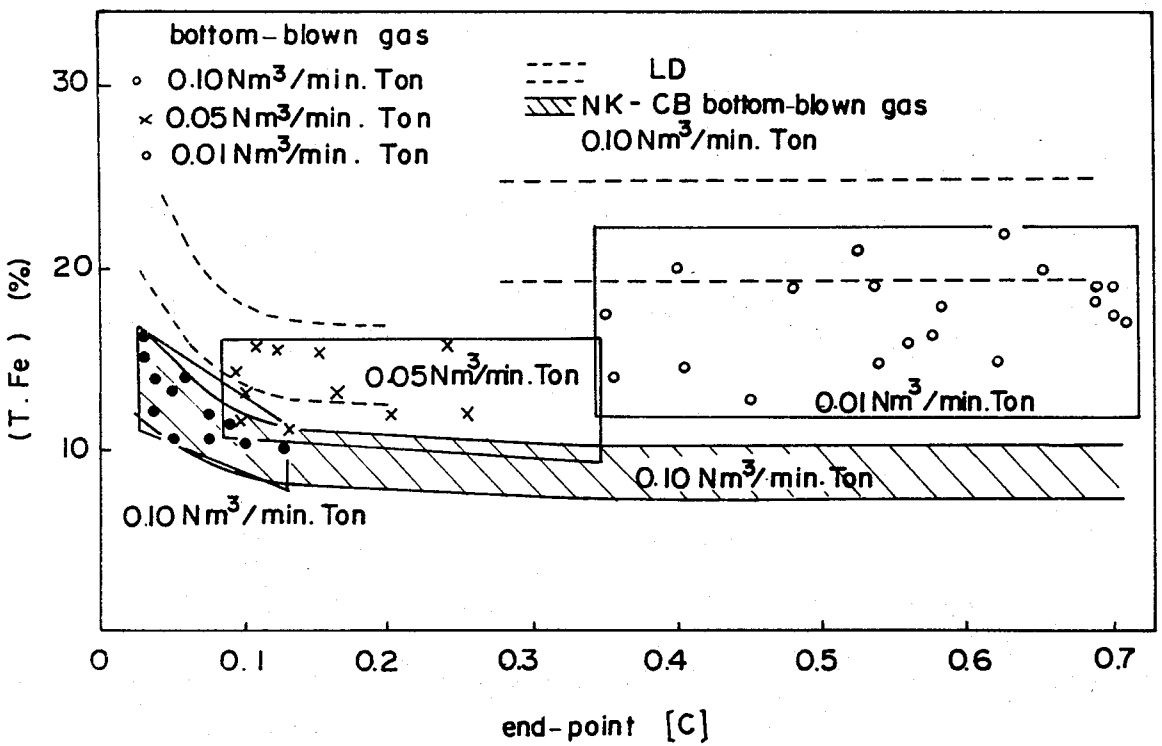
FIG. 33 is a graph showing the relationship between the bottom-blown gas and the end-point [C] and T.Fe contents.

As will be seen from FIG. 31, the end-point [P] of 0.006% can be ensured by the [P] input of 0.120%, and it is possible to ensure the ingot steel [P] content of 0.012% in consideration of the recovered phosphorus from the slag and the pickup from the alloys. FIG. 32 is a graph showing the relationship between the flow rate of bottom-blown gas and the end-point [C] and [P] contents, and FIG. 33 is a graph showing the relationship between the flow rate of bottom-blown gas and the end-point [C] content and the T.Fe content.

Figure 34:
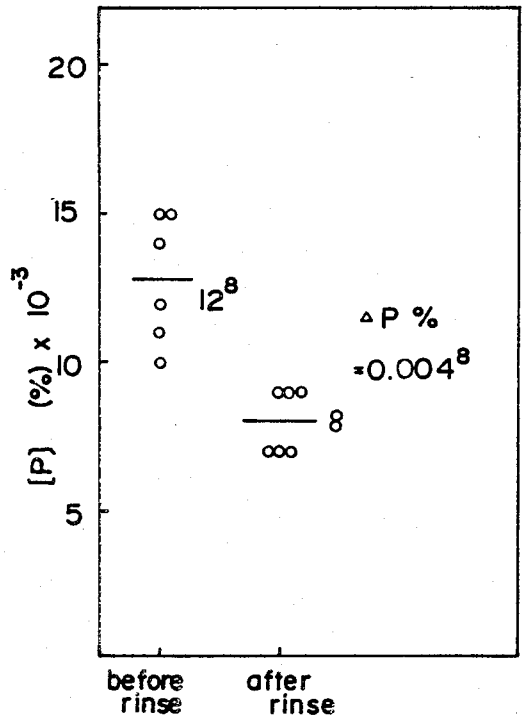
FIG. 34 is a graph showing the relationship between the [P] contents before and after the rinse.
Figure 35:
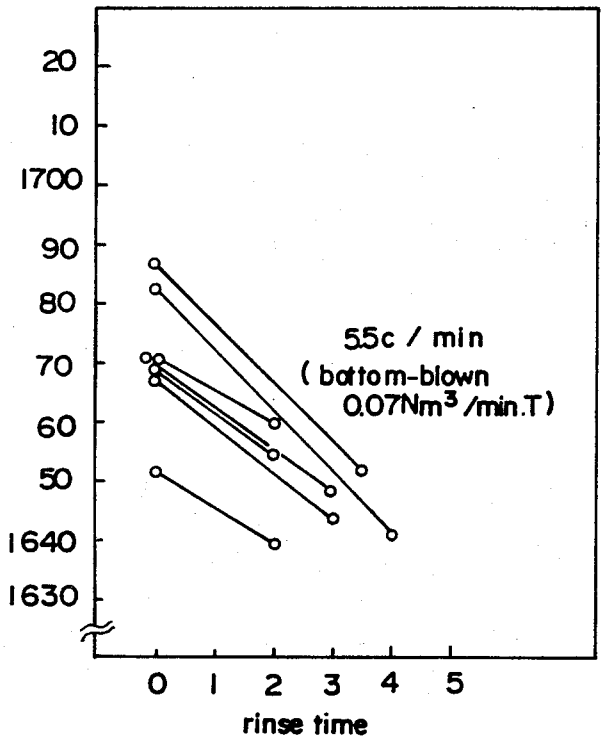
FIG. 35 is a graph showing the relationship between the rinse time and the temperature of the molten steel in the furnace.
Figure 36:
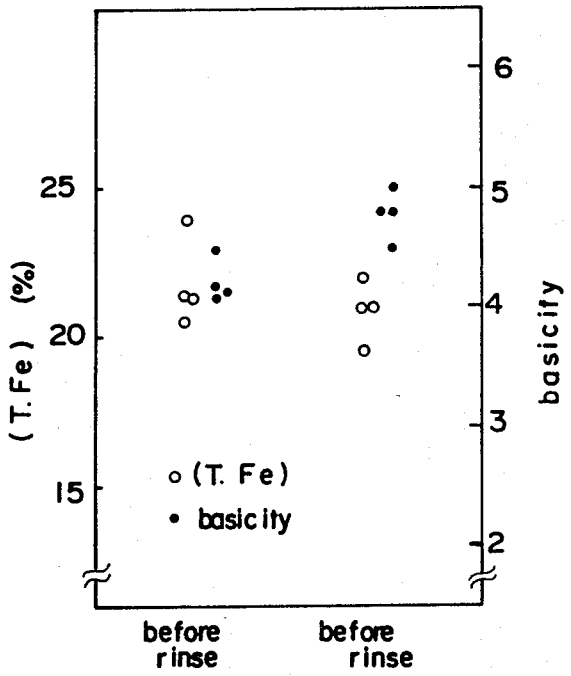
FIG. 36 is a graph showing the relationship between the (T.Fe) contents before and after the rinse.

Next, the important point of the method according to the seventh embodiment of the invention, that is, the effect of further blowing the bottom-blown gas alone after the completion of the blow refining (hereinafter referred to as a rinse effect) will be explained. FIG. 34 is a graph showing the changes in the [P] content before and after the rinse; FIG. 35 is a graph showing the temperature drop due to the rinse; and FIG. 36 is a graph showing the changes in the slag composition due to the rinse.

As will be seen from these Figures, the dephosphorization equilibrium after the rinse conforms with the previously mentioned dephosphorization equilibrium equation due to the slag composition (basicity), and the [P] and ($P_2O_5$) contents after the rinse. There is a condition which promotes the dephosphorization further, due to the increased (CaO), despite the decreased (T.Fe) content, in the slag composition and the decrease in the slag temperature caused by the rinse.

The method according to the seventh embodiment of the invention makes possible the production of low phosphorus steel in a top and bottom blowing converter using the single slag process and this has the effect of reducing the steelmaking time considerably as compared with the prior art methods.

We claim:

1. A bottom-blown gas blowing nozzle for a molten metal refining furnace, comprising a refractory including a plurality of holes having an inner diameter of from 0.5 to 3.0 mmϕ formed through said refractory and extending from a working surface to a back thereof, a metal cover enclosing at least a part of sides of said refractory, and a pressure box formed in a bottom portion of said refractory so as to communicate with said holes and define a gas reservoir space.

2. A bottom-blown gas blowing nozzle according to claim 1, wherein the space between said plurality of holes in said refractory is not less than 3 mm and not greater than 150 mm.

3. A bottom-blown gas blowing nozzle according to claim 1, wherein each of said plurality of holes in said refractory comprises a metal tube embedded in said refractory, and wherein each said metal tube has a wall thickness of not less than 0.1 mm and not greater than 10 mm.

4. A bottom-blown gas blowing nozzle according to claim 1, wherein said metal cover comprises a steel plate having a thickness of not less than 0.1 mm and not greater than 5 mm.

5. A bottom-blown gas blowing nozzle according to claim 1, wherein said gas reservoir space of said pressure box is defined by an upper metal plate and a lower metal plate with the distance between said upper and lower metal plates being not less than 2 mm and not greater than 50 mm.

6. A bottom-blown gas blowing nozzle according to claim 1, wherein externally arranged ones of said plurality of holes in said refractory are smaller in diameter than internally arranged ones of said plurality of holes.

7. A bottom-blown gas blowing nozzle according to claim 1, wherein said plurality of holes number from 10 to 150.

8. A bottom-blown gas blowing nozzle according to claim 1, wherein said nozzle comprises a plurality of unit nozzles in stages.

9. A bottom-blown gas blowing nozzle according to claim 1, wherein said nozzle has an overall length excluding a gas induction pipe of 500 mm or over.

10. A bottom-blown gas blowing nozzle according to claim 1, wherein said nozzle has a chemical composition comprising from 5 to 30% carbon and one or more compounds selected from the group consisting of MgO, $Al_2O_3$, CaO, $Cr_2O_3$ and $ZrO_2$.

* * * * *